US006615523B1

(12) United States Patent
Curbelo et al.

(10) Patent No.: US 6,615,523 B1
(45) Date of Patent: Sep. 9, 2003

(54) REVERSIBLE A-FRAME SIGN

(76) Inventors: Adrian Curbelo, 8018 NW. 103rd St., Hialeah, FL (US) 33016; Roberto Curbelo, 8018 NW. 103rd St., Hialeah, FL (US) 33016

( * ) Notice: Subject to any disclaimer, the term of this patent is extended or adjusted under 35 U.S.C. 154(b) by 0 days.

(21) Appl. No.: 09/712,011

(22) Filed: Nov. 14, 2000

Related U.S. Application Data

(60) Provisional application No. 60/169,222, filed on Dec. 6, 1999.

(51) Int. Cl.[7] ..... G09F 15/00

(52) U.S. Cl. ..... 40/606.15; 40/610; 40/612; 40/606.18; 116/638

(58) Field of Search ..... 40/606, 610, 612, 40/492; 116/63 P; 16/354

(56) References Cited

U.S. PATENT DOCUMENTS 2,881,662 A * 4/1959 Harris ..... 40/610
3,922,998 A * 12/1975 May ..... 116/63 P
4,279,105 A * 7/1981 Cameron ..... 40/606
4,298,186 A * 11/1981 Glass ..... 40/606
4,796,369 A * 1/1989 Hamann ..... 40/606
4,928,415 A * 5/1990 Walters ..... 40/610
4,999,937 A * 3/1991 Bechtold ..... 40/610
5,382,112 A * 1/1995 Fu ..... 404/6
5,544,614 A * 8/1996 Cushman ..... 116/63 P
5,887,373 A * 3/1999 Byers ..... 40/733
5,987,704 A * 11/1999 Tang ..... 16/354
6,003,257 A * 12/1999 Stokes ..... 40/610
6,393,748 B1 * 5/2002 Cooper ..... 40/610

* cited by examiner

*Primary Examiner*—Lynne H. Browne
*Assistant Examiner*—James M. Hewitt
(74) *Attorney, Agent, or Firm*—Robert M. Schwartz

(57) ABSTRACT

A display sign having a frame with a jointed hinge which allows the two display boards to be rotated 360 degrees to double the usable display area, the display boards can be removed and replaced, providing an unlimited array of sign combinations. The frames are opened via geared hinges until retainer straps are fully extended, this allows display boards to be viewed in an upright position, a strap socket is removed from a strap pivot post, and one frame is rotated approximately 360 degrees via a geared hinge. The retainer straps are then reattached to strap pivot posts, additional stability can be obtained by replacing end caps with ballast holders and ballast rods, alternately, the device can be mounted firmly atop a car via suction cups.

9 Claims, 5 Drawing Sheets

REVERSIBLE A-FRAME SIGN

CROSS-REFERENCE TO RELATED APPLICATIONS

This application claims the benefit of U.S. Provisional Patent Application No. 60/169,222 filed Dec. 6, 1999.

BACKGROUND OF THE INVENTION

1. Field of the Invention

This invention relates to display signs known as "A frame" signs, which generally consist of two printed boards which are joined at the top by a hinge joint.

2. Description of the Prior Art

A-Frame type signs have been used for a number of years and previous designs incorporate the same limitations which the claimed device eliminates. U.S. Pat. No. 4,624,210 to Glass (1986) shows an improved locking hinge mechanism which only permits the sign boards to be opened approximately 45 degrees. Another molded hinge assembly is claimed by U.S. Pat. No. 4,974,815 to Glass (1990), with similar limited display adjustability. Those hinges allow the boards to be positioned at an acute angle, thereby forming a freestanding sign capable of being seen from two directions. The major drawback of those designs is that only two outer faces. can carry printing, necessitating purchase of several complete signs if more than two messages are to be displayed. Other references, such as flashing light assemblies, do not exhibit the complete versatility of the invention claimed herein.

SUMMARY

The present invention is a hinged, freestanding sign featuring a unique geared hinge system and removable sign boards which allows for quick and efficient reconfiguration of displays. This permits the business to take full advantage of the sign's potential. The device is an improved "A-Frame" or "sandwich" sign which contains two substrate surfaces with printed information on each side.

Objects and Advantages

This device disclosed herein, comprises a display sign which is more versatile than designs shown in prior art. The two-in-one-sign of the present invention comprises a frame with a unique jointed hinge which allows each of two display boards to be rotated 360 degrees; this doubles the usable display area. Additionally, the display boards can be removed and replaced, thereby providing an unlimited array of sign combinations.

DRAWING FIGURES

DESCRIPTION OF THE PREFERRED EMBODIMENT

Figure 1:
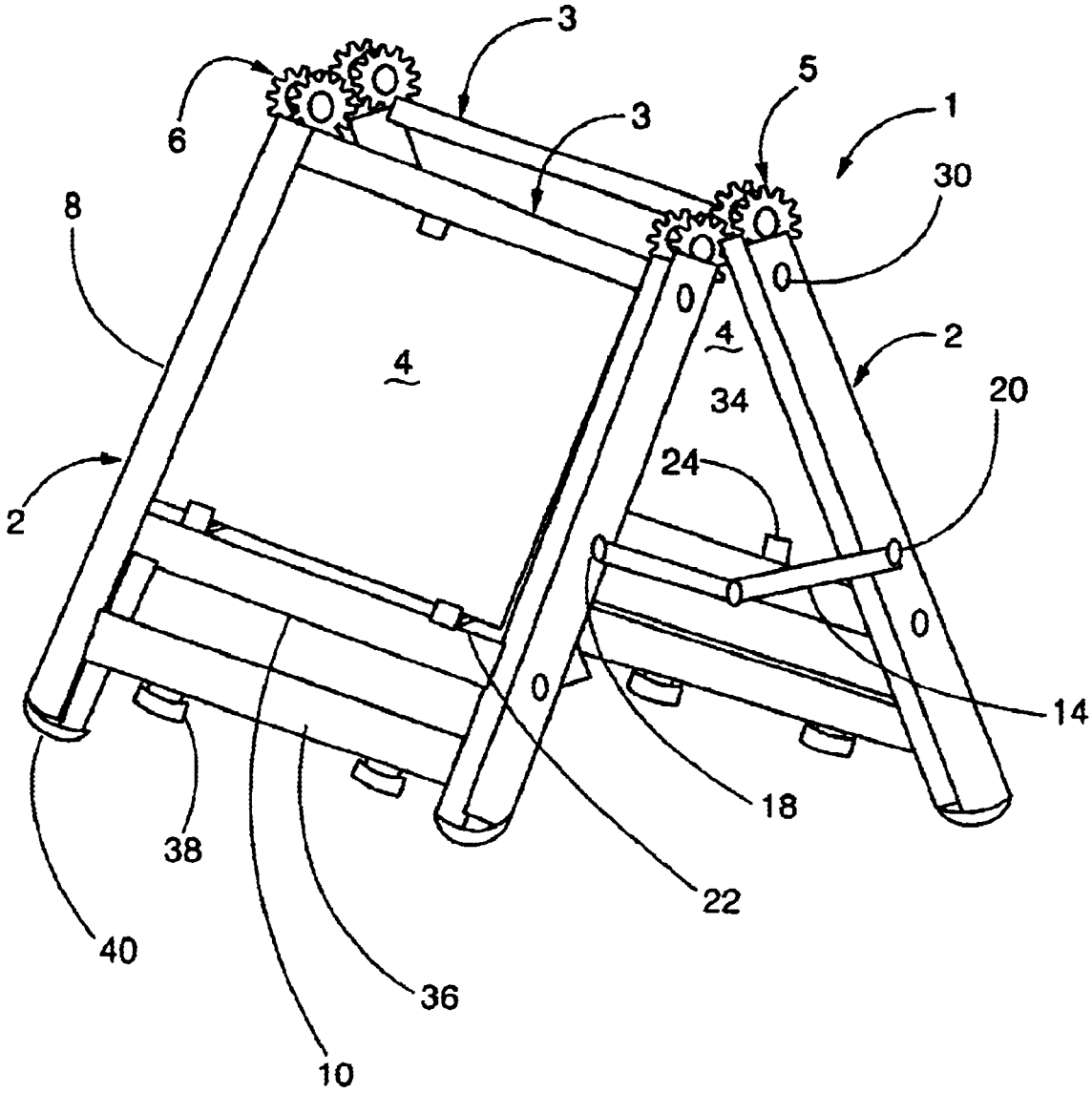
FIG. 1 is a perspective view of the device of the present invention.

The bottom flange of display board adapter base 22 is pressure fitted into channel 2 of cross rails 10. Display board 4 is held in place by display board adapter base 22 and display board adapter jaw 24, or by being mounted directly into channel 28 in side rails 8 and cross rails 10.

Each geared hinge 6 is composed of two parallel half gears permanently affixed to a base, which are held in constant engagement with another identical unit by axle 12. The base of each geared hinge 6 fits tightly into the open anterior end of each side rail 8, which connects frames 2 together. End caps 40 have flanges which are pressure fitted into the open bottom ends of side rails 8. Ballast holders 42 have tapered sides which allow them be pressure fitted into the bottom ends of side rails 8 in lieu of end caps 40. Ballast holders 42 allow ballast rods 44 to be held firmly within side rails 8.

Figure 8:
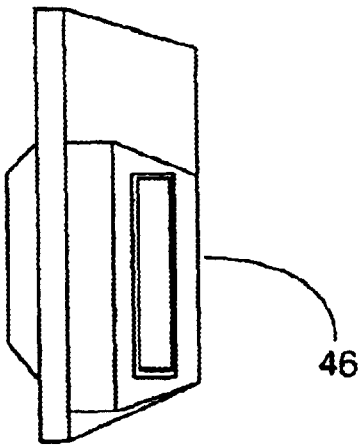
FIG. 8 is a perspective view of the suction attachment rail bracket.

Suction attachment rail 36 is mounted below lower cross rail 10 via suction attachment rail bracket 46, which has a reverse face that fits tightly into the ends of suction attachment rail 36 and an obverse face which fits tightly into channel 28 of side rail 8. Suction cups 38 are mounted onto the lower face of suction attachment rail 36. These components are shown in FIGS. 1 and 8.

Figure 5:
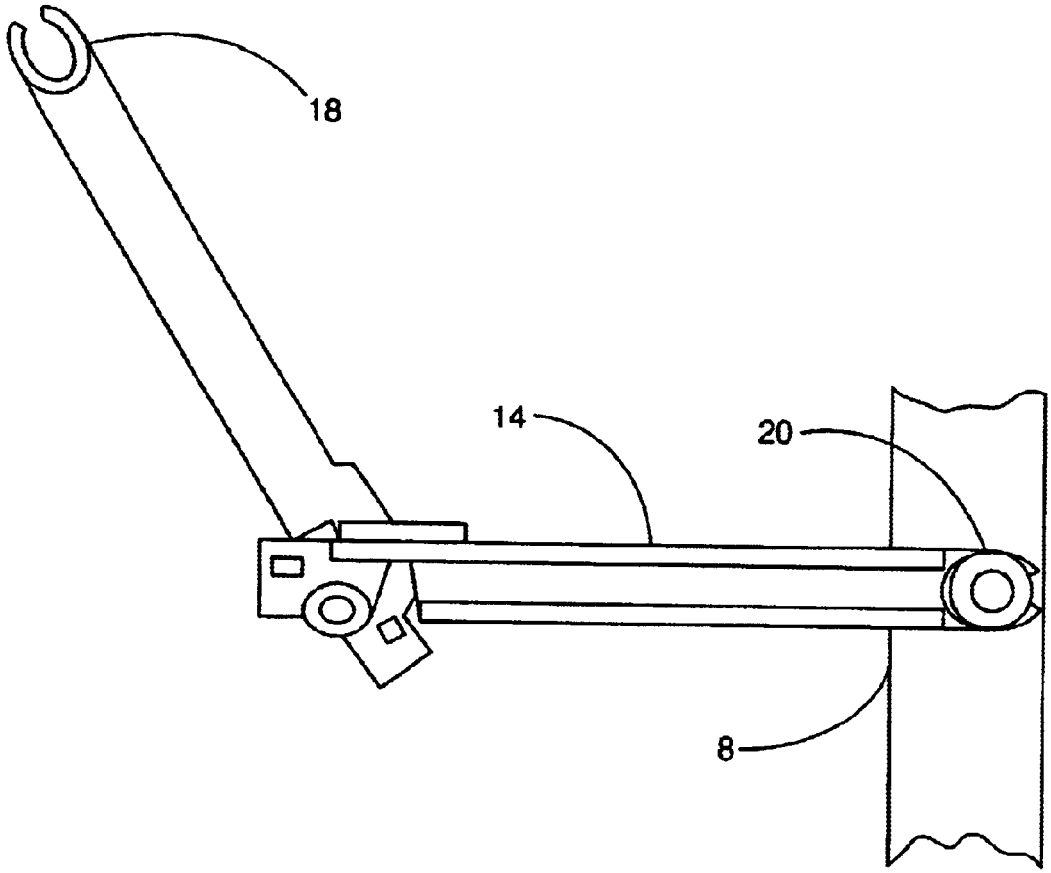
FIG. 5 is a side view of the retainer linkage 14.
Figure 6:
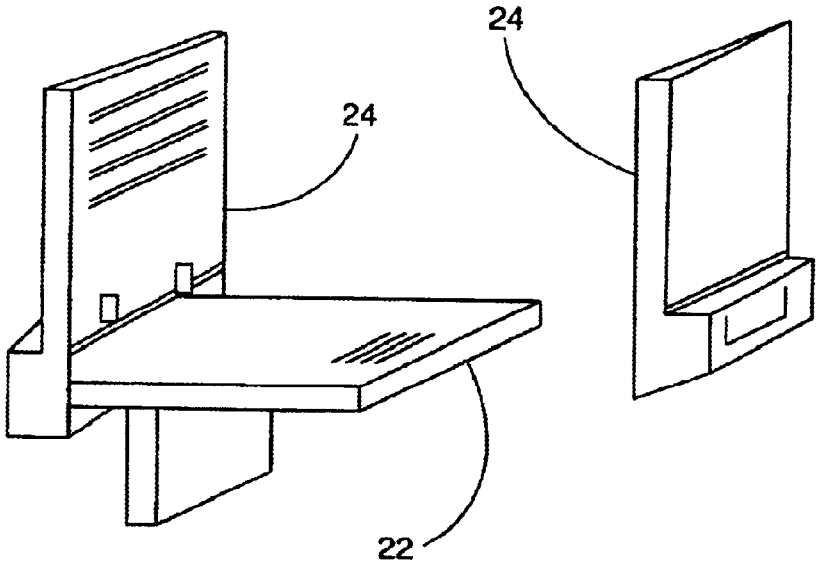
FIG. 6 is a perspective view of the display board adapter base and jaw.
Figure 7:
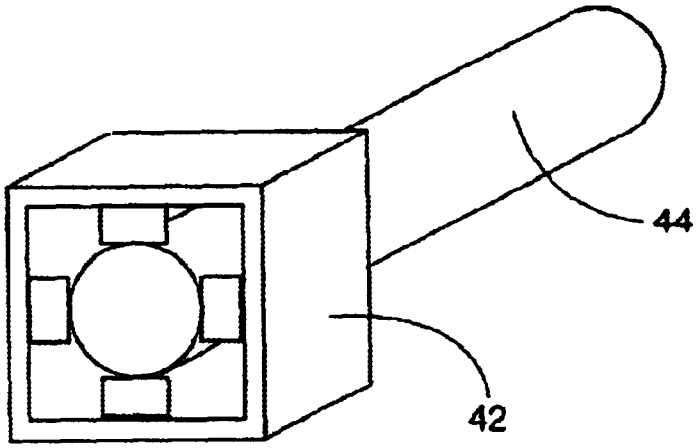
FIG. 7 is a perspective view of the ballast holder with ballast rod.

Retainer strap 14 shown in FIG. 5 is composed of two elongated flat strips connected at their anterior ends by a pivot joint. Strap socket 18 at the posterior end of each strip snap-fit onto strap pivot post 20 which is mounted onto side rail 8. The anterior end of one strip has a projection which engages a notch in the anterior end of the other strip when said strips are opened to 180 degrees.

FIG. 1 shows the reversible A-Frame sign 1, having a pair of opposed frames 2 pivotally attached at top 3 and which form support legs for display boards 4, said frames 2 are connected by toothed hinges 5 and 6 located at top 3 of the posterior ends of said tops 3. Each frame 2 consists of a pair of parallel side rails 8 rigidly connected together by cross rails 10 via frame screws (not shown). Frames 2 and cross rails 10 are long, hollow rectangular sections which feature U-shaped channel 28 running along the length of one side, as depicted in FIG. 5. Frames 2 and cross rails 8 are assembled to form open-centered rectangles with channels 28 are facing the inside of the open center. Screws pass through holes in each frame 2 and engage the terminal ends of channel 28 in each cross rail 10; screw caps 30 are then pressure fitted into said holes.

OPERATION

The preferred embodiment of this device is depicted in FIGS. 1. Frames 2 are opened via geared hinge 6 until retainer straps 14 are fully extended. This allows display boards 4 to be viewed in an upright position, with end caps 40 resting on the ground or another flat surface. Additional stability can be obtained by replacing end caps 40 with ballast holders 42 and ballast rods 44. Device can be mounted firmly atop a car via suctions cups 38; suction attachment rail can be completely removed by sliding suction attachment rail brackets 46 out of side rail channels 28.

Figure 2:
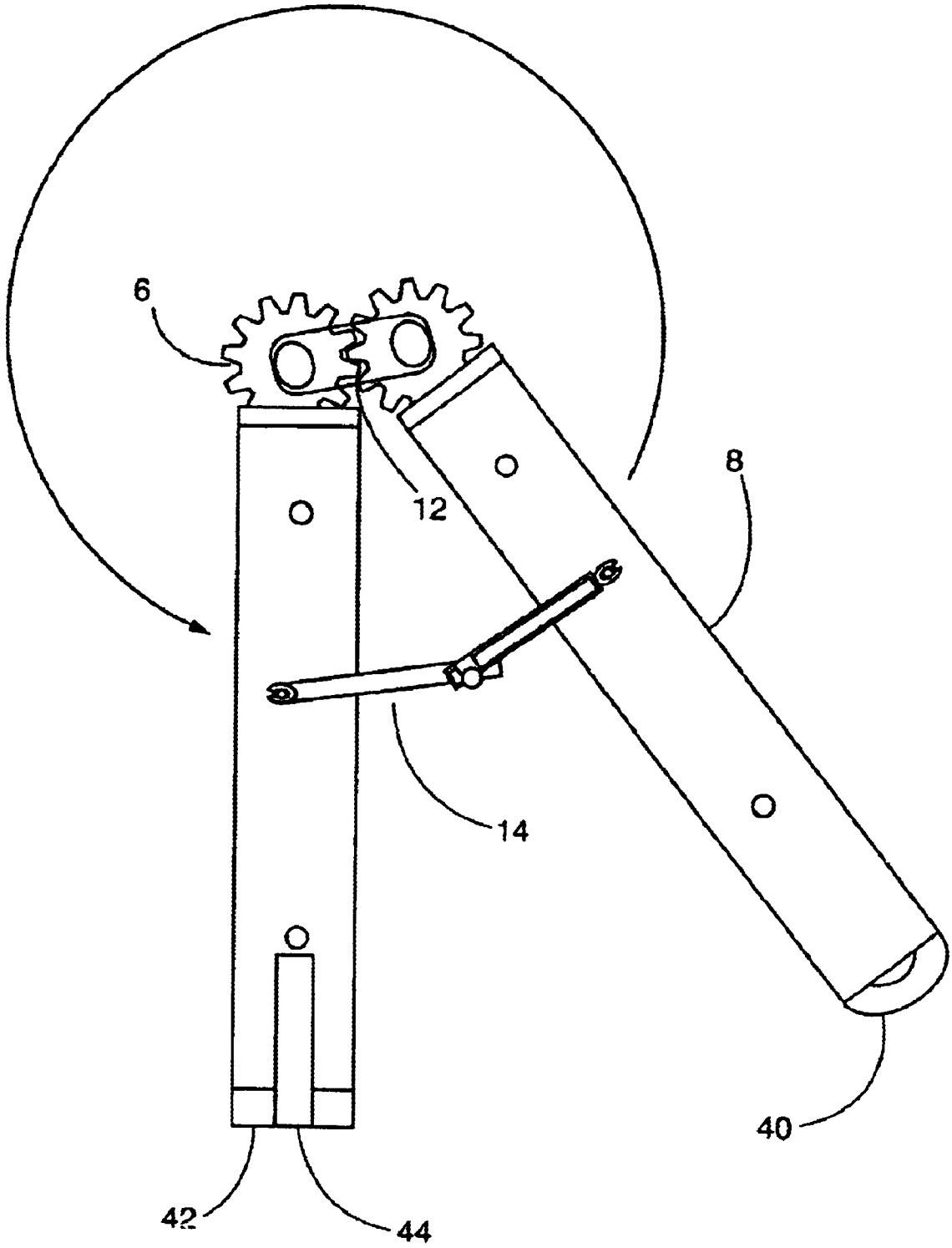
FIG. 2 is a side view of the present invention.
Figure 3:
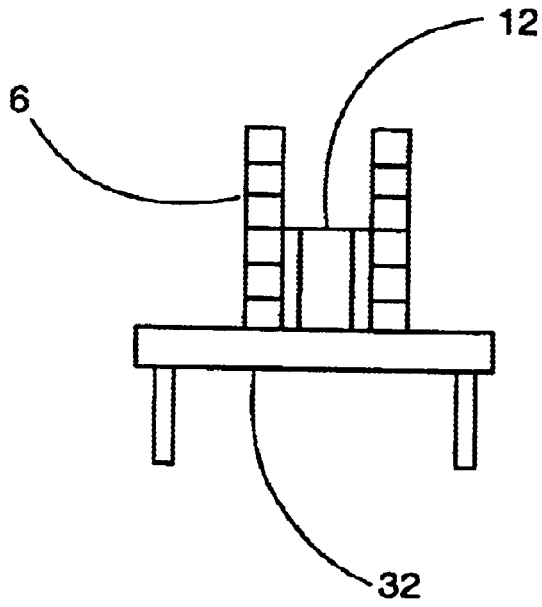
FIG. 3 is a front view of the geared hinge 6.
Figure 4:
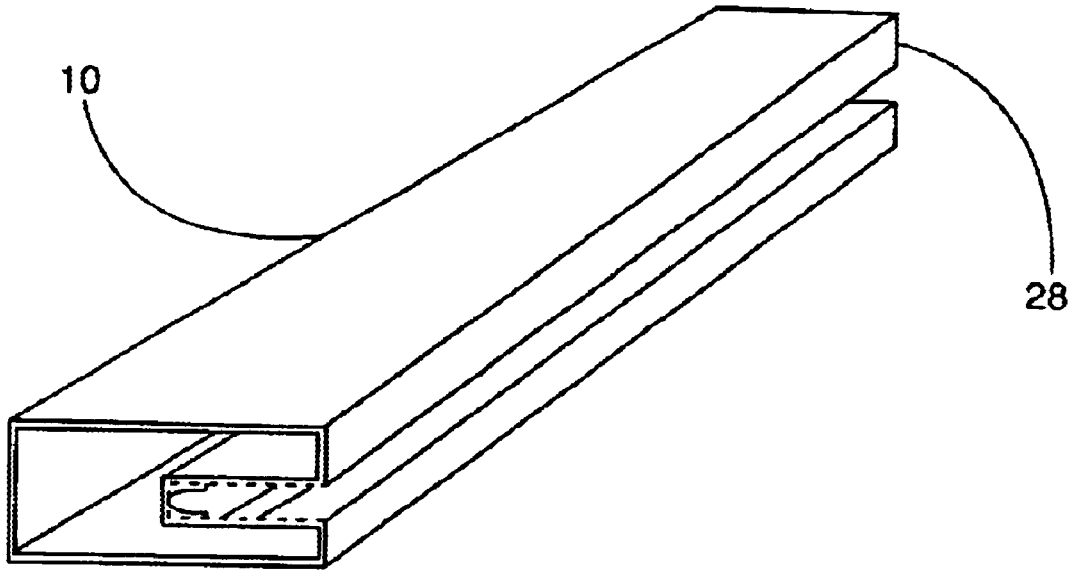
FIG. 4 is a perspective view of an uninstalled side/cross/section attachment rail.

The unique versatility of this device can be realized in two ways. Strap socket 18 is removed from strap pivot post 20, and on frame 2 is rotated approximately 120 degrees via geared hinge 6 as shown in FIG. 2. Retainer straps 14 are then reattached to strap pivot posts 20. This allows the reverse faces of display boards 4 to be quickly positioned for viewing (this device can also be folded 180 degrees until flat for compact storage). Display boards 4 can be removed and changed completely by releasing display board adapter jaw 24 from display board adapter base 22, then reinstalling with new boards in place. Display board adapter jaw 24 can be adjusted to various positions relative to display board adapter base 22, allowing various thicknesses of display board to be used. Alternately, display boards can also be installed directly into channels 28 in side rails 8 and cross rails 10.

Additional Embodiments

The channel can contain small teeth which help to hold display boards in place when placed directly into the channel. There is an area in the channel which has been designed for the screws that hold the frame together to be inserted. The teeth of channel also serve as a holding mechanism for the screw thread. The extrusion is given a painted finish. The channel also contains small teeth which hold in place the substrate when placed directly into the channel. There is an area in the channel which has been designed for the screws that hold the frame together to be inserted. The teeth of the channel also serve as a holding mechanism for the screw thread.

This device can be fabricated from extruded an painted aluminum, plastic or a combination of these materials. Display boards can be formed of plastic, wood, metal or composite material. Ballast rods are ideally made from steel, iron or lead bar stock. Any material listed herein are solely intended to serve as examples and should not imply any limitations on the scope of invention.

What is claimed is:

1. A reversible sign for displaying information comprising:

a pair of opposed frames, said frames hingedly connected for rotating one said frame relative to the other said frame;

a retainer strap having at least one strap socket for releasably securing said frames to one another in a first position and a second position, wherein said strap socket releasably secures to at least one strap pivot post on said frames;

at least one display board supported by each said frame, said display board having a first side and a second side for visually displaying information, wherein a first side of each said display board displays information in said first position and when said frames are rotated into said second position said second side of each said display board displays information; and wherein said at least one display board is releasably supported by a display board adapter jaw.

2. A reversible sign for displaying information comprising:

a first frame having a first end and a second end, said first frame supporting a display board;

a second frame having a first end and a second end, said second frame supporting a display board and said second frame hingedly attached to said first frame wherein said hinge is external and in proximity to said first ends of said first frame and said second frame;

each said display board having a first side and a second side, said first side and said second side of said display boards capable of displaying information;

at least one retainer strap having at least one strap socket for releasably securing said first frame to said second frame in a first position wherein said first sides of said display boards are capable of displaying information, wherein said strap socket releasably secures to at least one strap pivot post on said first frame, said at least one releasable retainer strap additionally securing said first frame to said second frame in a second position wherein said second sides of said display boards are capable of displaying information.

3. A reversible sign as set forth in claim 2, wherein said frames are hingedly connected at their first ends by a geared hinge that allows said first frame to rotate at least 300 degrees relative to said second frame.

4. A reversible sign as set forth in claim 2, wherein said frames are hingedly connected at their first ends by a geared hinge that allows said first frame to rotate at least 270 degrees relative to said second frame.

5. A reversible sign as set forth in claim 4, wherein said frames comprise a pair of side rails and a cross rail.

6. A reversible sign as set forth in claim 4, wherein said geared hinge comprises a first set of parallel half gears affixed to a base held in engagement to a second set of parallel half gears affixed to said base by an axle.

7. A reversible sign as set forth in claim 2, wherein said frames are hingedly connected at their first ends by a geared hinge that allows said first frame to rotate approximately 360 degrees relative to said second frame.

8. A reversible sign as set forth in claim 2, wherein said display boards are releasably supported by a display board adapter jaw.

9. A reversible sign as set forth in claim 2, wherein said second ends of said frames are constructed and arranged to engage a flat surface for supporting said sign in said first and said second positions.

* * * * *